United States Patent [19]

Gorbunov et al.

[11] Patent Number: 5,072,992

[45] Date of Patent: Dec. 17, 1991

[54] SHIELD UNIT

[76] Inventors: Valery F. Gorbunov, Pritomskaya Naberezhnaya, 1a, kv. 6; Alexandr F. Eller, prospekt Leningradsky, 3a, kv. 79; Alexandr Y. Tkachenko, Prospekt Lenina, 28, kv. 32; Vladimir V. Axenov, prospekt Oktyabrsky, 44, kv. 208; Vladimir D. Nagorny, prospekt Oktyabrsky 40, kv. 641, all of Kemerovo, U.S.S.R.

[21] Appl. No.: 543,853

[22] PCT Filed: Nov. 21, 1988

[86] PCT No.: PCT/SU88/00231

§ 371 Date: Jul. 23, 1990

§ 102(e) Date: Jul. 23, 1990

[87] PCT Pub. No.: WO90/05835

PCT Pub. Date: May 31, 1990

[51] Int. Cl.[5] ..... F21D 9/08

[52] U.S. Cl. ..... 299/33; 299/56; 405/141

[58] Field of Search ..... 299/31, 33, 55, 56, 299/68, 87; 405/138, 141; 175/94

[56] References Cited

U.S. PATENT DOCUMENTS 3,989,303 11/1976 Akkerman ..... 299/33

FOREIGN PATENT DOCUMENTS 1229354 5/1986 U.S.S.R. .
1328531 8/1987 U.S.S.R. .
2016554 9/1979 United Kingdom .

*Primary Examiner*—David J. Bagnell
*Attorney, Agent, or Firm*—Lilling & Lilling

[57] ABSTRACT

A shield unit has a cylindrical shell made up of two sections arranged in succession one after the other, that is, a head section and a tail section which are connected by a traversing mechanism. The mechanism is a differential planetary gear train kinematically associated with a mechanism for moving the tail section and a rock discharge mechanism. The head section is provided with a cutting tool and has a helical surface. The tail section is provided with a device preventing rotation of the tool section in rock.

7 Claims, 3 Drawing Sheets

SHIELD UNIT

BACKGROUND OF THE INVENTION

1. Field of the Invention

The present invention relates to the mining industry, construction and transport, and more particularly it relates to shield units.

The present invention can find most efficient application in mining, tunnelling, coal chuting, as well as in driving workings for switchgears and power plants.

2. Description of the Related Art

There is known a shield unit (SU, A, 1229354), comprising a cylindrical shell made up of two sections (head section and tail section) arranged in succession one after the other which are connected by means of a traversing mechanism, the head section being provided with a cutting tool, its outer portion having a helical surface, and the tail section being outfitted with a device preventing its rotation in rock. The tail section of the shield unit consists of two parts, the first one serving as a support in case the head section turns or moves and the second one serving as a support in case the first part of the tail section turns or moves. A helical surface is provided on the outer portion of the tail section. The traversing mechanism includes two groups of double-action hydraulic jacks. The first group of hydraulic jacks is used for turning and axial movement of the head section relative to the tail section. The second group of hydraulic jacks is used for turning and axial movement of the first part of the tail section relative to its second part. Each hydraulic jack is in fact a cylinder with a piston and a rod. The cylinders of hydraulic jacks of the first group are hinged to the inner surface of the first part of the tail section and their rods are hinged to the inner surface of the head section. The cylinders of hydraulic jacks of the second group are hinged to the inner surface of the second part of the tail section and their rods are hinged to the inner surface of the first part of the tail section. The device preventing rotation of the tail section includes two groups of double-action hydraulic jacks positioned in the first and second parts of the tail section, each part accommodating one group of the hydraulic jacks. The cylinders of these hydraulic jacks are hinged to the inner surface of the tail section and their rods are hinged to plates. One end of each plate is hinged to the inner surface of the tail section, while its other free end passes through a hole in the tail section to come into contact with rock. A provision is made for a rock discharge mechanism, which is in fact blades positioned radially about the geometric axis of the cylindrical shell and rigidly fixed to the cutting tool of the head section. The rock discharge mechanism is also provided with haulage facilities of any known type, say, cars.

During operation fluid is fed to the head ends of the hydraulic jack cylinders of the device preventing the tail section from rotating. The rods of these hydraulic jacks are hence brought forward to move the plates. The free ends of the plates pass through the holes in the tail section to come into contact with rock, thus ensuring that the tail section is firmly fixed in rock. Then the fluid is fed to the head ends of the hydraulic jack cylinders of the traversing mechanism for turning the head section relative to the first part of the tail section. As a result, the rods of these hydraulic jacks are brought forward, thereby turning the head section relative to the tail section. At the same time the head section moves along the axis of the cylindrical shell due to the helical surface provided on the outer portion of the head section. With the head section turning and moving axially at the same time, the cutting tool performs effective operation in rock. Disintegrated rock is picked up by the blades in the lower part of the head section and loaded into a haulage facility, such as a car inside the head section in its upper part. Then the fluid is fed to the rod ends of the first group of the hydraulic jack cylinders of the device preventing rotation of the tail section in rock. As a result, the first part of the tail section firmly fixed in rock gets free. At the same time the fluid is fed to the head ends of the hydraulic jack cylinders of the traversing mechanism for turning the first part of the tail section relative to its second part. The rods of these cylinders are hence brought forward and turn the first part of the tail section relative to its second part. At the same time the first part of the tail section moves along the axis of the cylindrical shell until it comes into contact with the head section of the unit. This movement is made possible due to the helical surface provided on the outer portion of the tail section.

With the first part of the tail section fixed in rock getting free and moving, the cutting tool performs no operation in rock since the head section is stationary at this point and these operations are, therefore, auxiliary. Then the second part of the tail section fixed in rock gets free and the first part of the tail section becomes fixed in rock, after which the second part of the tail section turns and moves axially until it comes into contact with its first part. The cutting tool performs no operation for the same reason in the process and consequently these operations are also auxiliary.

The shield unit of this type features low efficiency, which stems from the fact that its operating cycle involves alternating effective and auxiliary operations, the period of time required for auxiliary operations being several times longer than that required for effective operations. Besides, the unit of such a design features a hydraulic system comprising four groups of hydraulic jacks which is fairly difficult to handle and repair. It is only one group of hydraulic jacks, namely those of the traversing mechanism that is directly involved in performing effective operation in rock. The other three groups of hydraulic jacks are designed for auxiliary operations. Since the blades are rigidly fixed to the cutting tool in the head section and turn together with the latter, rock, being too loose, is not fully discharged out of the head section. It accumulates therein and hence increases both the weight of the head section and the expenditure of energy required to move it. Thus, the unit should be periodically stopped to remove accumulated rock from the head section either with some known mechanisms or manually. This effects efficiency of the unit. What is more, disintegrated rock is loaded into haulage facilities only with the unit shut down, i.e. rock disintegration and loading into haulage facilities cannot be combined, which also decreases efficiency of the unit.

SUMMARY OF THE INVENTION

It is the main object of the invention to provide a shield unit whose structural arrangement of the traversing mechanism and kinematic association thereof with the mechanism for moving the tail section and with the rock discharge mechanism ensure the efficiency of the unit, simplify its structure and facilitate its maintenance and repair.

In accordance with the foregoing and further objects, the invention resides in a shield unit comprising a cylindrical shell made up of two sections (head section and tail section) arranged in succession one after the other which are connected by means of a traversing mechanism, the head section being provided with a cutting tool, its outer portion having a helical surface, and the tail section being outfitted with a device preventing its rotation in rock. According to the invention, the traversing mechanism is a differential planetary gear train whose stationary sun wheel is a ring gear provided on the inner surface of the tail section which is engaged with gears of a double-planetary gear train whose pinions are engaged with a ring gear provided on the inner surface of the head section which is a driven sun wheel. The double-planet gear train is connected with a carrier made as a ring positioned coaxially with the cylindrical shell and kinematically associated with a prime mover shaft, the unit being provided with a mechanism for moving the tail section and with a rock discharge mechanism both kinematically associated with the traversing mechanism.

Such a structural arrangement of the traversing mechanism, the latter being kinematically associated with the mechanism for moving the tail section and with the rock discharge mechanism, has made it possible to perform effective operation in rock and auxiliary operations for moving the tail section and discharging rock at the same time. Thus, the unit of such a design performs continuous rock disintegration and hence its efficiency is higher than that of the known unit described herein above.

Besides, with the traversing mechanism made as described herein above, it has become possible to eliminate the need for a large number of hydraulic jacks with a complex hydraulic control system and hence simplify the design of the unit and make it easier to handle and repair.

It is expedient that the mechanism for moving the tail section be made as rollers arranged in two rows along the periphery of the outer surface of the ring, each roller being positioned on a pin fitted in the ring with provision for rotating, the geometric axis of the pin intersecting the geometric axis of the cylindrical shell at a right angle, the lateral surfaces of the rollers of one row being in contact with the end of the ring gear of the head section and the lateral surfaces of the rollers of the other row being in contact with the end of the ring gear of the tail section.

With the mechanism for moving the tail section made as described herein above, it has become possible to provide axial movement of the tail section and turning of the head and tail sections at the same time. This results in rock disintegration and movement of the tail section being accomplished at the same time, which increases efficiency of the unit.

It is desirable that the ring and the prime mover shaft be kinematically associated with each other by means of a shaft-mounted gear engaged with a ring gear provided on the outer surface of the ring element positioned coaxially with the ring and rigidly coupled therewith.

This kinematic linkage is most simple and reliable with the gearing having a high ratio.

It is expedient that the rock discharge mechanism comprise a tubular element positioned co-axially with the ring with provision for rotating, the end nearest the cutting tool having blades kinematically associated with a conveying screw whose pipe is positioned in the tubular element and provided with an inlet-pipe connection in the area of screw conveyor blades.

It is desirable that the rock discharge mechanism and the traversing mechanism be kinematically associated with each other by means of plates positioned radially with respect to the geometric axis of the cylindrical shell, one end of each plate being fitted to the end of the ring and the other end being fitted to the outer surface of the tubular element.

Such a constructional arrangement of the rock discharge mechanism kinematically associated with the traversing mechanism makes it possible to disintegrate and discharge rock at the same time, thereby increasing efficiency of the unit. The kinematic linkage of the conveying screw and blades enables loading of the screw conveyor with rock to be carried out simultaneously with its loading into haulage facilities located outside the unit.

The kinematic linkage between the rock discharge mechanism and the traversing mechanism as described herein above is most simple and reliable, which simplifies the design of the unit.

Besides, with the disclosed kinematic linkage, the rotation speed of the conveying screw and blades is equal to that of the traversing mechanism ring considerably exceeding that of the head section.

The difference in rotation speed of the blades and head section facilitates rock loading into the screw conveyor and hence rules out the possibility of inadequate rock discharge out of the head section. Thus, there can be no stoppage of the unit due to inadequate rock discharge out of the head section, which increases its efficiency.

It is expedient that the conveying screw and blades be kinematically associated with each other by means of plates positioned radially with respect to the geometric axis of the cylindrical shell, one end of each plate being fitted to the conveying screw and the other end being fitted to the respective blade.

The kinematic linkage as described herein above is most simple and reliable, which simplifies the design of the unit.

It is expedient that the device preventing rotation of the tail section in rock be made as trapezoidal plates positioned radially with respect to the geometric axis of the cylindrical shell, its larger bases being fitted to the outer surface of the tail section.

Such a constructional arrangement of the device preventing rotation of the tail section in rock reliably prevents the tail section from turning in rock about the geometric axis of the cylindrical shell with the unit moving axially. The shape of the plates facilitates their penetration into rock.

BRIEF DESCRIPTION OF THE DRAWINGS

The present invention will now be disclosed in a detailed description of an illustrative embodiment thereof with reference to the accompanying drawings, wherein.

DESCRIPTION OF THE PREFERRED EMBODIMENT OF THE INVENTION

Figure 1:
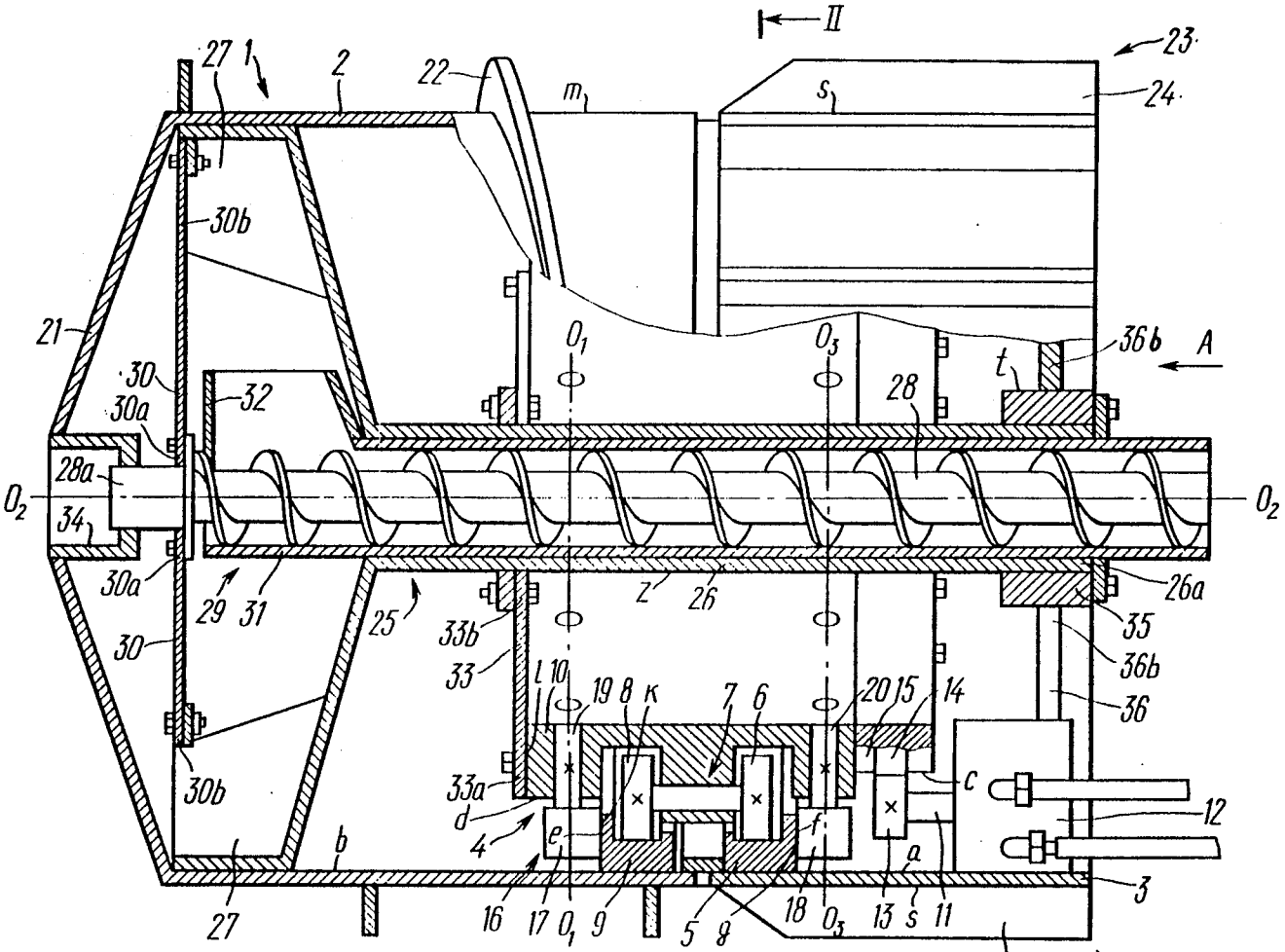
FIG. 1 is a longitudinal section view of a shield unit according to the invention.

Given below is a description of an embodiment of a shield unit used when working in soft rocks. The shield unit comprises a cylindrical shell 1 (FIG. 1) made up of two sections 2, 3 (head section 2 and tail section 3) arranged in succession one after the other. The head section 2 and the tail section 3 are interconnected by means of a traversing mechanism 4. The traversing mechanism 4 is a differential planetary gear train whose stationary sun wheel is a ring gear 5 provided on the inner surface a of the tail section 3 which is engaged with gears 6 of a double-planet gear train 7. Pinions 8 of the double-planet gear train 7 are engaged with a gear ring 9 provided on the inner surface b of the head section 2 which is a driven sun wheel of the differential planetary gear train. The The ring gears 5 and 9 have a different number of teeth. The double-planet gear train 7 moves by dint of a carrier made as a ring 10 positioned co-axially with the cylindrical shell 1. The ring 10 is kinematically associated with a shaft 11 of a prime mover 12. The kinematic linkage is in fact a gear 13 mounted on the shaft 11 which is engaged with a ring gear 14. The ring gear 14 is provided on the outer surface c of a ring element 15 positioned co-axially with the ring 10 and rigidly coupled therewith.

The unit is provided with a mechanism 16 for moving the tail section kinematically associated with the traversing mechanism 4. The mechanism 16 for moving the tail section is in fact rollers 17, 18 arranged in two rows along the periphery of the outer surface d of the ring 10. Each roller 17 of one row is positioned on a pin 19 fitted in the ring 10 with provision for rotating, the geometric axis $0_1$—$0_1$ of the pin intersecting the geometric axis $0_2$—$0_2$ of the cylindrical shell 1 at a right angle. Each roller of the other row is positioned on a pin 20 fitted in the ring with provision for rotating, the geometric axis $0_3$—$0_3$ of the pin 20 intersecting the geometric axis $0_2$—$0_2$ of the cylindrical shell 1 at a right angle. The lateral surfaces e of the rollers 17 of one row are in contact with the end k of the ring gear 9 of the head section 2. The lateral surfaces f of the rollers 18 of the other row are in contact with the end g of the ring gear 5 of the tail section 3.

The head section 2 is provided with a blade-type cutting tool 21 and its outer portion m has a helical surface 22. The tail section 3 is provided with a device 23 preventing its rotation in rock made as trapezoidal plates 24 positioned radially with respect to the geometric axis $0_2$—$0_2$ of the cylindrical shell, the larger bases of the plates 24 being fitted to the outer surface s of the tail section 3.

The unit is provided with a rock discharge mechanism 25 kinematically associated with the traversing mechanism 4. The rock discharge mechanism 25 comprises a tubular element 26 positioned co-axially with the ring 10 with provision for rotating, the end nearest the cutting tool 21 having blades 27 kinematically associated with a screw 28 of a conveyor 29.

The kinematic linkage is in fact plates 30 positioned radially with respect to the geometric axis $0_2$—$0_2$ of the cylindrical shell 1. One end 30*a* of each plate 30 is fitted to the screw 28 of the conveyor 29 and the other end 30*b* of each plate, to the respective blade 27. A pipe 31 of the screw conveyor 29 is positioned co-axially in the tubular element 26 and provided with an inlet-pipe connection 32 in the area of the blades 27 of the screw conveyor 29.

Figure 2:
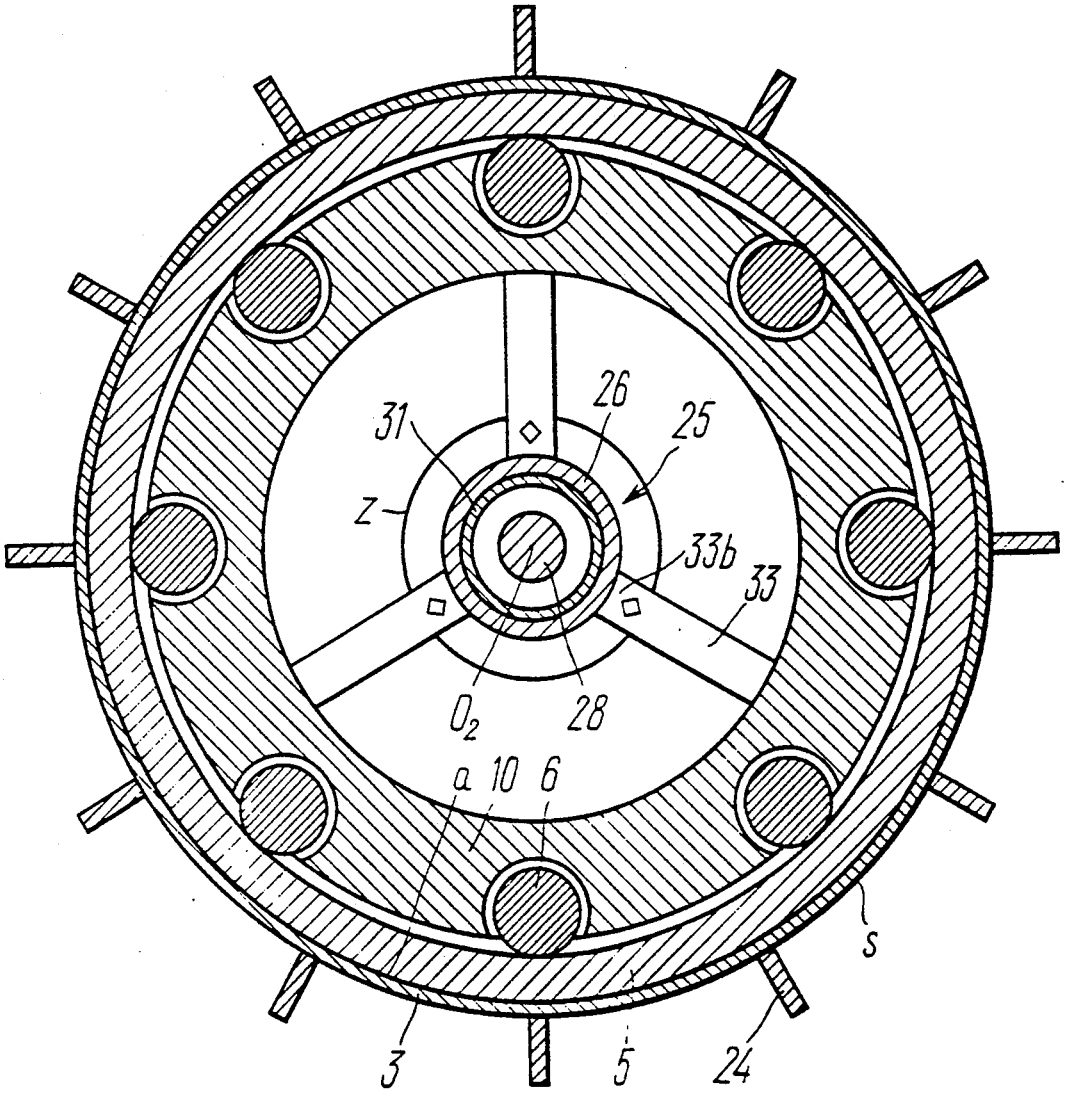
FIG. 2 is a section on line II—II in FIG. 1.
Figure 3:
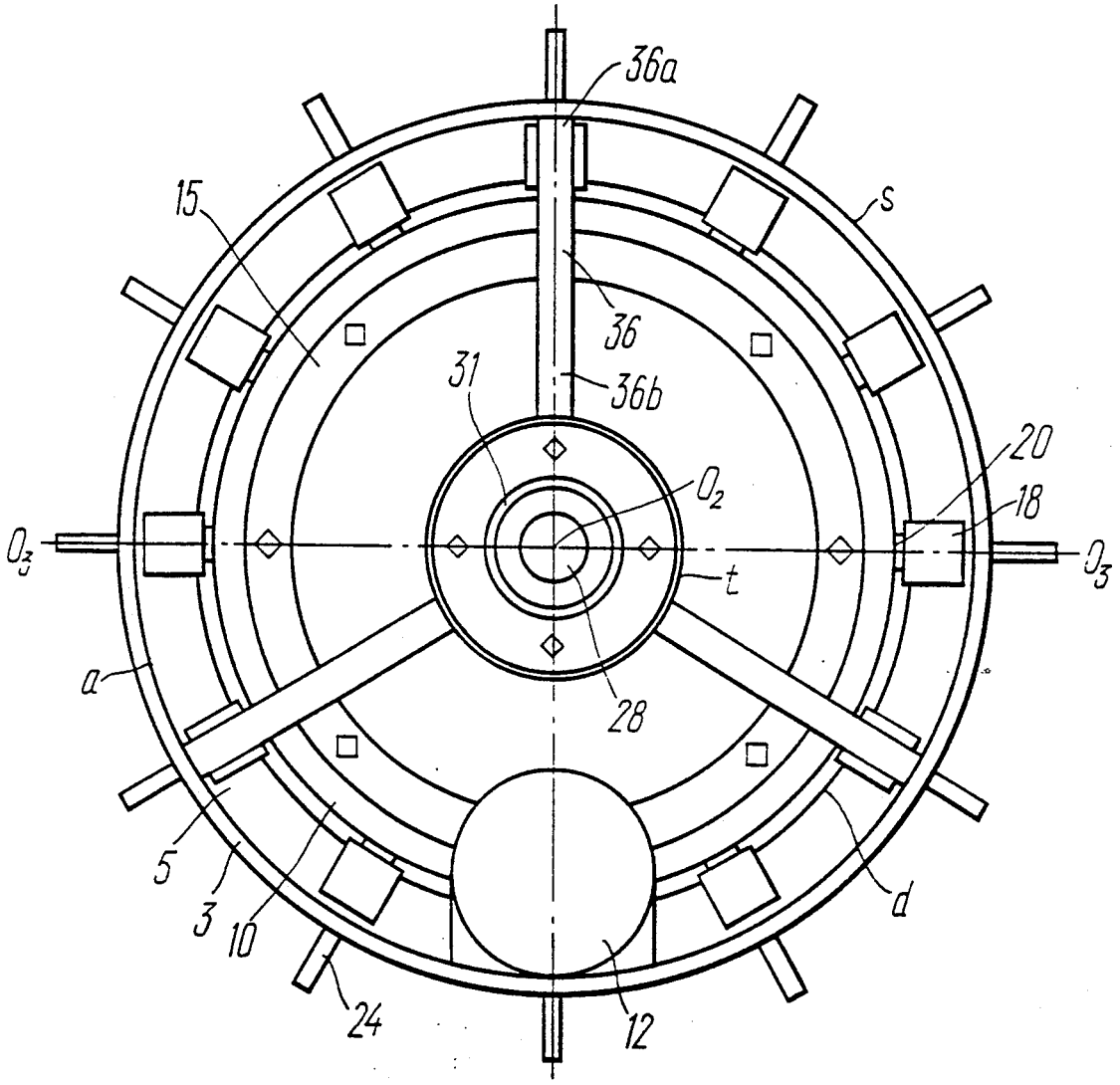
FIG. 3 is a view facing the arrow A in FIG. 1.

The rock discharge mechanism 25 and the traversing mechanism 4 are kinematically associated with each other by dint of plates 33 positioned radially with respect to the geometric axis $0_2$—$0_2$ of the cylindrical shell 1. One end 33*a* of each plate 33 is fitted to the end l of the ring 10 and the other end 33*b* (FIG. 2) of each plate 33, to the outer surface z of the tubular element 26. An end 28*a* (FIG. 1) of the conveyor 29 screw 28 is fitted with provision for rotating in a sleeve 34 (FIG. 1) positioned in the cutting tool 21 co-axially with the axis $0_2$—$0_2$ of the cylindrical shell 1. Provided in another sleeve 35 is an end 26*a* of the tubular element 26, the sleeve 35 being positioned co-axially with the axis $0_2$—$0_2$ of the cylindrical shell 1 by means of plates 36 (FIG. 3) arranged co-axially with the axis $0_2$—$0_2$ of the cylindrical shell 1. One end 36*a* of each plate 36 is fitted to the inner surface a (FIG. 1) of the tail section 3 and the other end 36*b* (FIG. 3) of each plate 36 is fitted to the outer cylindrical surface t of the sleeve 35 (FIG. 1).

The shield unit operates as follows. The unit is installed in a pit specially provided for this purpose (when working at shallow depths) or in an underground chamber. Then the unit is loaded with rock or some backfill material, after which the prime mover 12 (FIG. 1) is cut in. The torque developed by the prime mover 12 is imparted from the shaft 11 to the gear 13, wherefrom it is imparted to the ring gear 14 and the ring element 15, the latter starting to rotate. The ring 10 starts rotating together with the ring element 15. All the components accommodated in the ring 10, namely the double-planet gear train 7 and the rollers 17, 18 turn about the axis $0_2$—$0_2$ of the cylindrical shell 1. As this takes place, the pinions 8 of the double-planet gear train 7 roll the ring gear 9 of the head section 2 and the gears 6 of the double-planet gear train 7 roll the ring gear 5 of the tail section 3. The head and tail sections 2, 3 turn relative to each other because of the different number of teeth in the ring gears 5 and 9. With the head section 2 rotating, it moves forward due to its helical surface 22 provided on its outer portion m. Thus, the head section 2 has translational and rotary motion in rock. As a result, the cutting tool 21 makes circular cuts in rock. The head section 2 with the ring gear 9 fitted therein moves the rollers 17 fixed in the ring 10 of the traversing mechanism 4, the ring 10 imparting this motion to the other rollers 18 and then to the ring gear 5 of the tail section 3. As a result, the head section 2 moving in rock carries the tail section 3 along. The plates 24 of the device 23 for preventing rotation of the tail section in rock keep the tail section from rotating.

At the same time rotation of the ring 10 is imparted to the tubular element 26 of the rock discharge mechanism 25 by dint of the plates 33, wherefrom it is imparted to the blades 27 and, further on, to the conveyor screw 28 by dint of the plates 30. Disintegrated rock is picked up by the blades 27 and directed to the inlet-pipe connection 32 from whence it comes to the conveyor screw 28. The screw 28 of the conveyor 29 moves disintegrated rock along the axis $0_2$—$0_2$ of the cylindrical shell 1 to the tail section 3 and discharges it into haulage facilities (not shown).

The present invention can find most efficient application in mining, tunnelling, coal chuting, as well as in driving workings for switchgears and power plants.

What we claim is:

1. A shield unit, comprising: a cylindrical shell having a head section and a tail section arranged in succession one after another, the head section and the tail section being connected by a traversing mechanism, the head section being provided with a cutting tool, an outer portion of the cutting tool having a helical surface and the tail section having means for preventing rotation of the tail section in rock, the traversing mechanism comprising a differential planetary gear train having a stationary sun wheel, the stationary sun wheel being a first ring gear provided on an inner surface of the tail section and engaged with gears of a double-planet gear train having pinions engaged with a second ring gear provided on an inner surface of the head section, the second ring gear being a driven sun wheel, the double-planet gear train being connected with a carrier, the carrier being a first ring positioned coaxially with the cylindrical shell and being connected to a shaft of a prime mover, the shield unit further comprising a mechanism for moving the tail section connected to the traversing mechanism and a rock discharge mechanism connected to the traversing mechanism.

2. A shield unit as claimed in claim 1, wherein the mechanism for moving the tail section comprise rollers arranged in two rows along a periphery of an outer surface of the first ring, each roller being positioned on a pin fitted in the first ring with provision for rotating, a geometric axis of the pin intersecting a geometric axis of the cylindrical shell at a right angle, lateral surfaces of the rollers of one row being in contact with an end of the second ring gear of the head section and lateral surfaces of the rollers of another row being in contact with an end of the first ring gear of the tail section.

3. A shield unit as claimed in claim 1, wherein the first ring and the shaft of the prime mover are connected by means of a gear mounted on the shaft and engaged with a third ring gear provided on an outer surface of a ring element positioned coaxially with the first ring and rigidly coupled therewith.

4. A shield unit as claimed in claim 1, wherein the rock discharge mechanism comprises a tubular element positioned co-axially with the first ring with provision for rotating, an end of the tubular element nearest to the cutting tool having screw conveyor blades connected with a conveying screw of a conveyor having a pipe co-axially positioned in the tubular element and provided with an inlet-pipe connection in an area of the screw conveyor blades.

5. A shield unit as claimed in claim 4, wherein the screw conveyor blades and the conveying screw of the conveyor are connected with each other by means of plates positioned radially with respect to a geometric axis of the cylindrical shell, one end of each plate being fitted to the conveying screw and another end of each plate being fitted to a respective screw conveyor blade.

6. A shield unit as claimed in claim 1, wherein the rock discharge mechanism and the traversing mechanism are connected with each other by means of plates positioned radially with respect to a geometric axis of the cylindrical shell, one end of each plate being fitted to an end of the first ring, and another end of each plate being fitted to an outer surface of the rock discharge mechanism.

7. A shield unit as claimed in claim 1, wherein the means for preventing rotation of the tail section in rock comprises trapezoidal plates positioned radially with respect to a geometric axis of the cylindrical shell, larger bases of the trapezoidal plates being fitted to an outer surface of the tail section.

* * * * *